US005438949A

United States Patent [19]

Day

[11] Patent Number: 5,438,949

[45] Date of Patent: Aug. 8, 1995

[54] HYDROSTATIC RELEASE WITH A COMPOSITE PLUNGER ASSEMBLY

[75] Inventor: Ronald H. Day, Marin County, Calif.

[73] Assignee: Raftgo Hendry Manufacturing Co., Novato, Calif.

[21] Appl. No.: 190,774

[22] Filed: Feb. 1, 1994

[51] Int. Cl.[6] ..... B63C 9/22

[52] U.S. Cl. ..... 114/367; 24/602; 24/634; 24/645; 405/171; 441/10

[58] Field of Search ..... 114/367; 441/10; 24/602, 603, 634, 635, 645, 648; 405/171

[56] References Cited

U.S. PATENT DOCUMENTS 2,360,848 10/1944 Bryan .
2,824,315 2/1958 McKenny .
2,839,767 6/1958 Sieverts ..... 114/367
3,534,418 10/1970 Adams, Jr. .

FOREIGN PATENT DOCUMENTS 2113754 8/1983 United Kingdom ..... 114/367

*Primary Examiner*—James R. Brittain

*Attorney, Agent, or Firm*—Flehr, Hohbach, Test, Albritton & Herbert

[57] ABSTRACT

A hydrostatically releasable coupling assembly for releasably securing a buoyant object to a vessel with a lashing strap. The coupling assembly includes a pair of lashing plates, a cooperative latching mechanism carried by the lashing plates for releasably coupling the lashing plates together and a composite plunger assembly coupled to one of the lashing plates for movement between a release position and a locking position. The plunger assembly has a first diameter portion shaped for release of the latching mechanism for movement from an engaged position to a disengaged position when the plunger assembly is in the release position, and a second diameter portion formed of plastic and shaped to retain the latching mechanism in an engaged position when the plunger assembly is in the locking position. The plunger assembly also includes an intermediate metal portion between the first diameter portion and the second diameter portion for substantially minimizing contact between the latching mechanism and the second diameter portion when the latching mechanism is disengaged.

16 Claims, 3 Drawing Sheets

HYDROSTATIC RELEASE WITH A COMPOSITE PLUNGER ASSEMBLY

BACKGROUND OF THE INVENTION

1. Field of the Invention

The present invention relates in general to a hydrostatically releasable coupling assembly and, more particularly, to a hydrostatic release with a composite plunger assembly.

2. Description of the Prior Art

Hydrostatically releasable coupling devices such as those shown in U.S. Pat. Nos. 2,824,315 and 3,534,448 are often used with a strap or other lashing arrangement to releasably secure buoyant objects to a vessel. Should the vessel sink, the hydrostatic pressure at a particular depth will cause the coupling device to become disengaged, releasing the life raft. In general, the hydrostatically releasable coupling device includes a latching mechanism and some form of a stop which may be interposed between the components of the latching mechanism to retain the mechanism in an engaged position. A diaphragm is coupled to the stop for moving the stop into and out of alignment with the latching components. During normal use, a spring urges the diaphragm in one direction to position the stop between the latching components. In the event the vessel sinks, the hydrostatic pressure at a predetermined depth depresses the diaphragm to compress the spring and separate the stop from the latching mechanism to release the life raft or other buoyant object. The coupling device may also be manually released by depressing the stop.

The hydrostatic release must operate within the specific depth ranges prescribed by various regulatory agencies. The coupling devices must be tested before shipment and periodically during the life of the device to ensure that the hydrostatic release is functioning properly. In general, the coupling devices are tested by hydrostatically depressing the diaphragm to separate the stop from the latching components while the device is under a tensioning load as required by the regulating body. If the latching mechanism fails to operate at the prescribed depth range, the hydrostatic release may fail to meet the stringent requirements established by the regulatory agencies.

The components of most hydrostatic releases, even though formed of a metal such as stainless steel, may rust or corrode because of the essentially constant exposure of the hydrostatic release to moisture and salt. Thus, rust and corrosion may accumulate on the contacting surfaces of the stop and latching components causing them to stick in the engaged position. The force that is needed to move the stop from between the latching components increases with the formation of rust. The depth at which the hydrostatic release will operate changes with the increasing amount of hydrostatic pressure required to release the latching mechanism. Depending upon the extent of rust accumulation, the hydrostatic release may fail to meet the stringent requirements set by the regulatory agencies. The formation of rust often has a substantial effect on the operation and life the coupling devices. Substantially minimizing the accumulation of rust between the stop and the latching mechanism would improve the operation of the hydrostatic release and extend the useful life of the coupling device.

SUMMARY OF THE INVENTION

Accordingly, a primary object of the present invention is to provide an improved hydrostatically releasable coupling assembly.

A further object of the present invention is to provide a coupling assembly with a substantially rust resistant plunger.

Another object of the present invention is to provide such a coupling assembly which may be repeatedly tested to ensure that the hydrostatic release operates within the prescribed depth and tension load range.

A more general object of the present invention is to provide a hydrostatically releasable coupling assembly which may be efficiently and economically manufactured and maintained.

In summary, the hydrostatically releasable coupling assembly of the present invention includes a pair of lashing plates and a cooperative latching mechanism. The latching mechanism may be moved to an engaged position to secure the lashing plates together, thereby lashing a buoyant object to the deck of a vessel, and to a disengaged position to separate the lashing plates and release the object. A plunger assembly coupled to one of the lashing plates has a first diameter portion, a second diameter portion formed of plastic, and an intermediate metal portion between the first and second diameter portions. The plunger assembly may be moved between a locking position with the second diameter portion thereby engaging the latching mechanism and a release position with the first diameter portion permitting disengagement of the latching mechanism and separation of the lashing plates. The metal portion minimizes contact between the latching mechanism and the plastic second diameter portion while the plunger assembly is moved from its engaged position to its disengaged position. In one form of the present invention, the metal portion is of a reduced diameter relative to the second diameter portion so that when the locking mechanism is engaged by the second diameter portion, the metal portion is spaced from the locking mechanism.

BRIEF DESCRIPTION OF THE DRAWINGS

Additional objects and features of the present invention will be more apparent from the following detailed description and the appended claims, when taken in conjunction with the drawings, in which:

DETAILED DESCRIPTION OF THE INVENTION

Figure 1:
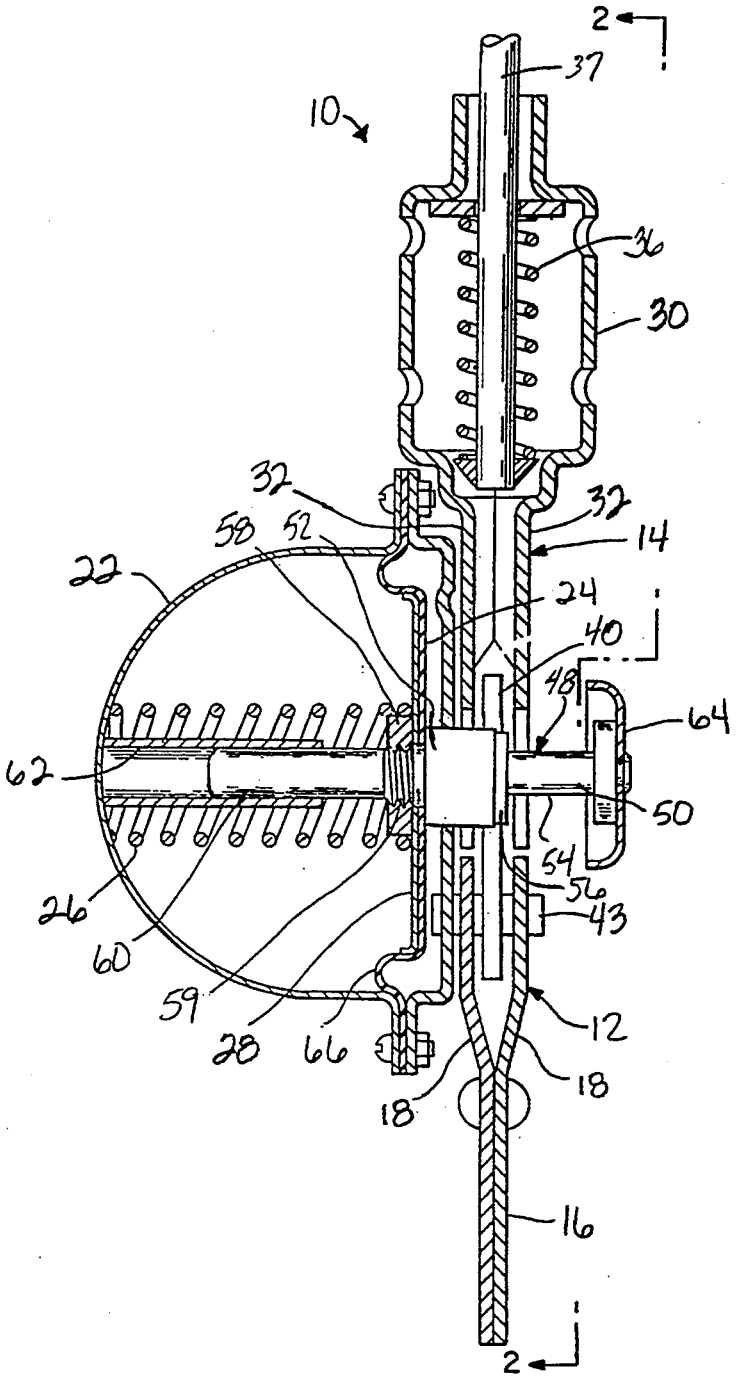
FIG. 1 is a cross sectional elevational view of a hydrostatic release in accordance with the present invention showing the plunger assembly in the locking position.

Reference will now be made in detail to the preferred embodiment of the invention, which is illustrated in the accompanying figures. Turning now to the drawings, wherein like components are designated by like reference numerals throughout the various figures, attention is directed particularly to FIG. 1.

A hydrostatically releasable coupling assembly 10 incorporating the present invention is shown in FIGS. 1–4. The hydrostatic release 10, which is particularly suitable for releasably securing a buoyant object to a vessel with a lashing strap (not shown), includes first and second coupling members 12 and 14. The coupling members 12 and 14 may be of the type shown in U.S. Pat. Nos. 2,824,315 and 3,534,318 or they may be of any other conveniently available type. In general, first coupling member 12 includes a first rigid lashing plate 16 which is formed of a pair of sheets 18. A cup 22 mounted to the plate assembly 16 houses a diaphragm 24, a spring 26 and a backup plate 28 disposed between the diaphragm and spring. Second coupling member 14 includes a second rigid lashing plate 30 formed of sheets 32. As is shown in FIG. 1, a compression spring 36 is retained about a rod 37 and between sheets 32 of the lashing plate 30. When the coupling members 16 and 30 are secured together, tension is applied between the assembly 16 and the rod 37 to thereby compress the spring 36 and place the coupling members under tension. Placing the coupling members under tension ensures that the coupling members may be easily separated when the coupling assembly 10 is released.

Figure 2:
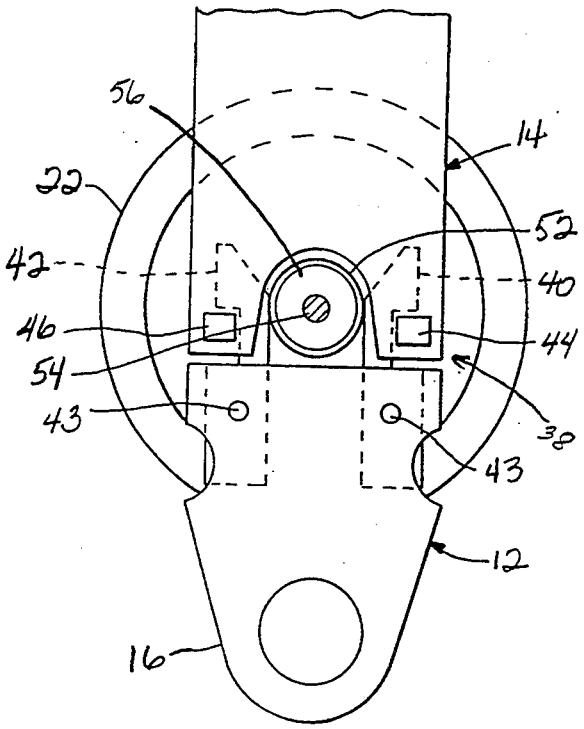
FIG. 2 is a sectional plan view taken along the lines 2—2 of FIG. 1 showing the lashing plates in their engaged position.
Figure 3:
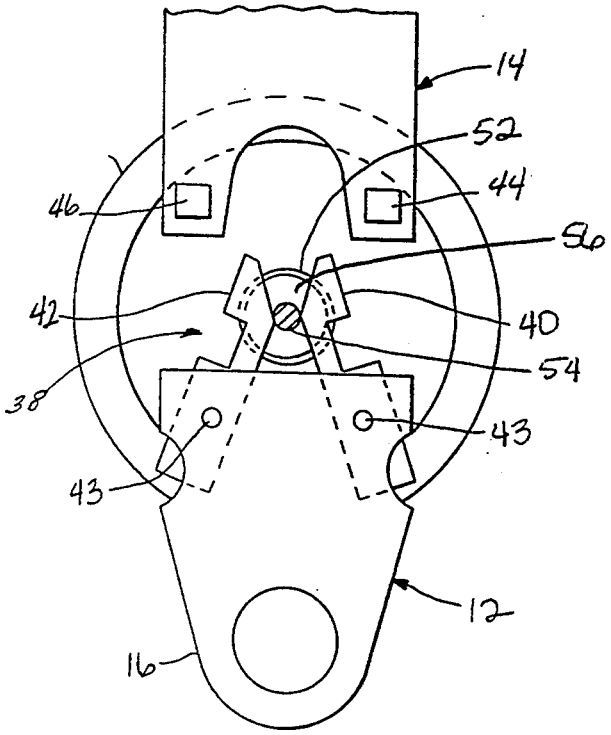
FIG. 3 is a sectional plan view taken along the lines 3—3 of FIG. 2 showing the lashing plates in their disengaged position.

As is shown particularly in FIGS. 2 and 3, the coupling members 12 and 14 include a latching mechanism, generally designated 38, for releasably securing the coupling members together. In the present embodiment, the latching mechanism 38 includes a pair of dogs 40 and 42 pivotally mounted between sheets 18 of the first lashing plate 16 by pins 43 and a pair of lugs 44 and 46 mounted between sheets 32 of second lashing plate 30. The dogs 40 and 42 are pivoted outward about pins 43 toward the lugs 44 and 46 to an engaged position where the dogs cooperate with the lugs to secure the coupling members together. The dogs may be pivoted inward toward one another to a disengaged position, with the dogs 40 and 42 clearing the lugs 44 and 46, to permit separation of the coupling members 12 and 14.

Figure 5:
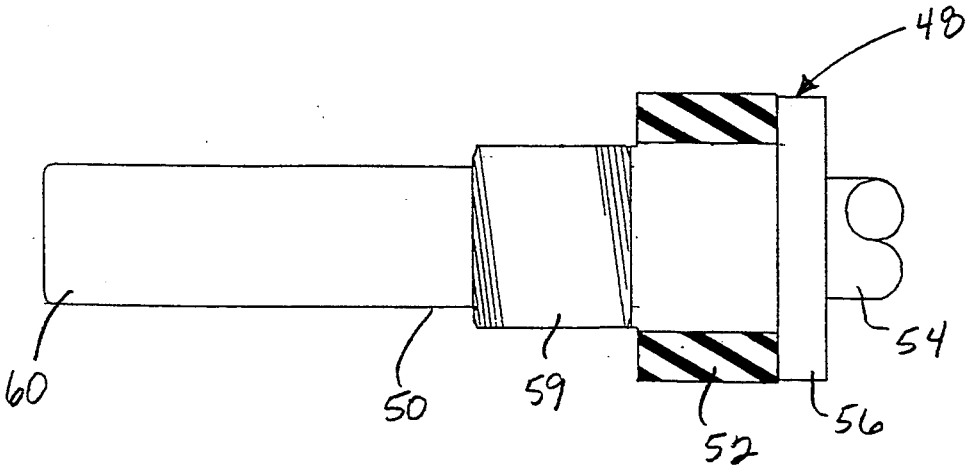
FIG. 5 is a cross sectional elevational view, partially broken away, of the plunger assembly of the hydrostatic release of FIG. 1.

The first coupling member 12 also includes a composite plunger assembly 48 which may be used to retain the latching mechanism in the engaged position. The plunger assembly 48 includes a plunger 50 formed of metal and a plastic body 52 mounted to the plunger 50. In the illustrated embodiment, plastic body 52 is provided by a plastic collar, although it should be understood that the body 52 may also take other forms. As shown in FIG. 5, the plunger body 50 defines a first diameter portion, generally designated 54, while the plastic collar 52 defines a second diameter portion. The collar 52 abuts an intermediate metal portion 56 which forms a part of the plunger body. The intermediate metal portion 56 may be in the form of a large diameter portion of the plunger body or in the form of a metal disc or metal band mounted to the plunger body. The intermediate metal portion 56 is mounted to the plunger body 50 between the first diameter portion and the plastic collar. As is shown particularly in FIG. 5, the metal portion 56 is of a slightly reduced diameter relative to the plastic collar 52. For example, for a plastic collar having a diameter of approximately 0.760 inches, the metal portion 56 may have a diameter of approximately 0.742 inches. The plunger body 50 and the metal disc 56 are preferably formed of stainless steel, but may be formed of another suitable material.

Figure 4:
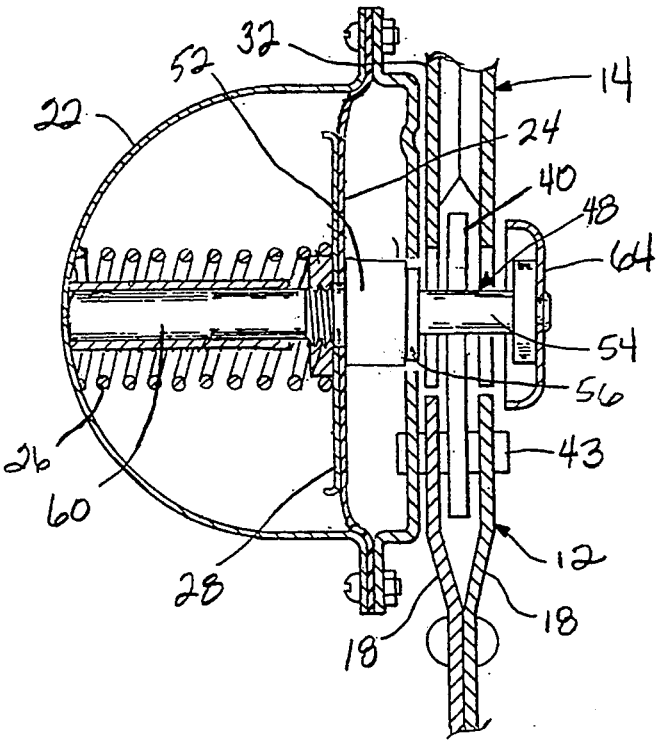
FIG. 4 is a cross sectional view similar to FIG. 1 but showing the plunger assembly in the release position.

The plunger assembly 48 may be moved between a locking position (FIG. 1) and a release position (FIG. 4) for alternately retaining the latching mechanism in an engaged position and releasing the mechanism 38 so that the lashing plates 16 and 30 may be separated. When the assembly 48 is in the locking position, shown in FIGS. 1 and 2, the dogs 40 and 42 have been pivoted outward about pins 43 toward the lugs 44 and 46 and the plastic collar 52 is interposed between the inner ends of the dogs 40 and 42. The plastic collar retains the dogs 40 and 42 in cooperative engagement with the lugs 44 and 46 and prevents inward pivotal movement of the dogs toward one another. Thus, the latching mechanism is secured in an engaged position when the collar 52 is interposed between the dogs. As shown in FIGS. 3 and 4, the first diameter portion 54 of the plunger is aligned with the dogs 40 and 42 when the plunger assembly is in the release position. The first diameter portion has a sufficiently narrow width to enable the dogs to pivot inwardly and become disengaged from the lugs 44 and 46. Once the dogs clear the lugs, the lashing plates 16 and 30 may be separated.

As is shown in FIG. 1, the plunger assembly 48 is mounted to the diaphragm 24 by a nut 58 cooperating with threaded portion 59. A narrow extension of the plunger body, generally designated 60, extends through the central opening of the spring 26 and is received by a sleeve guide 62 mounted to the interior of the cup 22. The spring 26 urges the diaphragm and the plunger assembly outward to the position shown in FIG. 1 to retain the plunger assembly in the locking position with the plastic collar or second diameter portion interposed between the dogs 40 and 42. By depressing the diaphragm and compressing the spring, the plunger assembly may be moved to the release position shown in FIG. 4 to align the-narrower first diameter portion 54 with the dogs.

The coupling assembly 10 may be manually disengaged by depressing button portion 64 of the plunger assembly to move the assembly 48 to the release position. As the first diameter portion 54 is aligned with dogs 40 and 42, the latching mechanism 38 may be moved to the disengaged position and the coupling members 12 and 14 separated as the tension applied by spring 36 is released. The coupling assembly 10 may also be hydrostatically released in the event the vessel sinks, submerging the coupling device to a predetermined depth prescribed by the regulating agencies, usually a maximum depth of 13 feet. The diaphragm is depressed into the cup, compressing the spring, by the hydrostatic pressure applied when the device is submerged to the predetermined depth. The plunger assembly 48 is moved by the diaphragm to the release position to interpose the first diameter portion between the dogs. In response to the buoyant load applied by the life raft or other object, the dogs 40 and 42 are pivoted inwardly, releasing the latching mechanism, and the lashing plates 16 and 30 are separated.

Since the coupling members 12 and 14 are retained under tension, the dogs 40 and 42 tend to snap against the plunger assembly when the assembly 48 is moved from the locking position to the release position. As the plunger assembly is moved, the dogs pass over the upper end of the second diameter portion with considerable force. Intermediate metal portion 56 separates the plastic collar 52 from the first diameter portion 54 of the plunger, minimizing the contact between the dogs 40 and 421and the plastic collar as the dogs are snapped to the release position. The metal portion 56 receives most of the impact of the dogs 40 and 42, protecting the plastic collar. Even though the collar 52 is preferably fabricated of a material having a high compressive strength, the impact caused by the dogs 40 and 42 would potentially damage the upper end of the plastic collar after repeatedly releasing the coupling assembly 10, reducing the effectiveness of the collar in retaining the latching mechanism in the engaged position. With the metal portion 56, the coupling assembly 10 may be repeatedly tested without damaging the plastic collar 52.

With the coupling assembly of the present invention, the formation of rust between the latching mechanism and the plunger assembly is substantially minimized. The plastic collar 52 of the plunger assembly is interposed between the dogs 40 and 42 when the plunger assembly is in the locking position. In the present embodiment, the metal portion 56 is of reduced diameter so that the metal portion is spaced form the dogs 40 and 42. The metal portion may be of the same diameter as the plastic collar if the dogs 40 and 42 are shaped and positioned so that when the latching mechanism is engaged, the dogs are aligned with the plastic collar and do not overlap the metal portion. Since the inner ends of the dogs 40 and 42 contact plastic, not metal, the accumulation of rust and corrosion between the contacting surfaces is substantially limited. Even after long periods of use, the plunger assembly 48 will not stick in the locking position but may instead be easily moved, manually or in response to hydrostatic pressure, to the release position.

When in use, the hydrostatic assembly is exposed to a substantial amount of moisture and salt. The plastic collar 52 must withstand the compressive forces which are applied to the collar when the dogs 40 and 42 are retained in the engaged position. The plastic collar is preferably formed of a material having a high compressive strength and limited water absorption characteristics. One suitable material is an acetal homopolymer as for example the acetal resin which is sold under the registered trademark "DELRIN" by E. I. du Pont de Nemours & Co. Acetal homopolymer has a compressive strength in the range of 16,000 to 18,000 psi, with the strength being retained over a wide range of humidities. Acetal also offers low moisture absorption, generally in the range of 0.12 to 0.25 percent after twenty-four hours and in the range of 0.80 to 0.90 percent when saturated. Another suitable material is a thermoplastic polyester having a compressive strength on the order of 15,000 psi and a moisture absorption on the order of 0.07 percent after twenty-four hours. While forming the collar of acetal is preferred because of the high compressive strength and moisture absorption characteristics, the plastic collar may also be fabricated of other suitable materials.

In the present embodiment, the area of the diaphragm 24 is greater than the area across the open end of the cup 22 so that the excess material is taken up with at least one roll 66. In operation, the excess material of the diaphragm rolls so that the plunger assembly 48 may be moved a sufficient distance for the first diameter portion 54 to be aligned with the dogs 40 and 42. Since the plunger assembly may be moved to the release position without stretching the diaphragm material, the hydrostatic pressure is resisted by the spring 26 instead of the combination of a spring and the stretch of the diaphragm material. The diaphragm 24 is preferably fabricated of synthetic rubber or elastomer, but may also be made of a fabric reinforced rubber, leather or other flexible materials. Although a diaphragm 24 with at least one roll 66 is preferred, other types of diaphragms as for example a flat diaphragm may be used with the coupling assembly of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A hydrostatically releasable coupling assembly for releasably securing a buoyant object to a vessel with a lashing strap, said coupling assembly comprising:

a pair of lashing plates;

cooperative latching means carried by said lashing plates for releasably coupling said lashing plates together, said latching means being movable between an engaged position for securing said lashing plates together and a disengaged position for separating said lashing plates; and a composite plunger assembly coupled to one of said lashing plates for movement between a release position and a locking position, said plunger assembly having a first diameter portion shaped for release of said latching means for movement from said engaged position to said disengaged position when said plunger assembly is in said release position and a second diameter portion shaped to retain said latching means in said engaged position when said plunger assembly is in said locking position, said second diameter portion being formed of plastic, said plunger assembly further including a metal portion between said first diameter portion and said second diameter portion for substantially minimizing contact between said latching means and said second diameter portion when said latching means is moved from said engaged position to said disengaged position.

2. A hydrostatically releasable coupling assembly as defined in claim 1 wherein said metal portion has a reduced diameter relative to said second diameter portion such that when said plunger assembly is in said locking position, said latching means is spaced from said metal portion.

3. A hydrostatically releasable coupling assembly as defined in claim 1 wherein said plunger assembly includes a plunger body and said second diameter portion is provided by a plastic collar mounted to said plunger assembly.

4. A hydrostatically releasable coupling assembly as defined in claim 1 wherein said plastic body is formed of one of an acetal homopolymer and a thermoplastic polyester.

5. A hydrostatically releasable coupling assembly as defined in claim 1 wherein said metal portion is a metal disc.

6. A hydrostatically releasable coupling assembly as defined in claim 1 wherein latching means includes a pair of lugs mounted to one of said lashing plates and a pair of dogs pivotally mounted to the other of said lashing plates, said dogs engaging said lugs when said latching means is in said engaged position.

7. A hydrostatically releasable coupling assembly as defined in claim 1 wherein one of said lashing plates includes spring means for urging said latching means from said engaged position to said disengaged position when said plunger assembly is moved to said release position.

8. A hydrostatically releasable coupling assembly as defined in claim 1 and including means responsive to hydrostatic pressure for moving said plunger assembly from said locking position to said release position.

9. A hydrostatically releasable coupling assembly for releasably securing a buoyant object to a vessel with a lashing strap, said coupling assembly comprising:

first and second lashing plates;

cooperative latching means carried by said lashing plates for releasably coupling said lashing plates together, said latching means being movable between an engaged position for securing said lashing plates together and a disengaged position for release of said lashing plates; and one of said lashing plates including a plunger assembly having a plunger body defining a first diameter portion, a plastic collar mounted to said plunger body defining a second diameter portion, and an intermediate metal portion proximate said plastic collar, said plunger assembly being movable between a locking position with said second diameter portion retaining said latching means in said engaged position and a release position with said first diameter portion positioned for movement of said latching means from said engaged position to said disengaged position;

said latching means and said metal portion being shaped and positioned such that when said plunger assembly is in said locking position, said metal portion is spaced from said latching means, said metal portion substantially minimizing contact between said latching assembly and said plastic collar when said latching means is moved from said engaged position to said disengaged position.

10. A hydrostatically releasable coupling assembly as defined in claim 9 wherein latching means includes a pair of lugs mounted to one of said lashing plates and a pair of dogs pivotally mounted to the other of said lashing plates, said dogs engaging said lugs when said latching means is in said engaged position.

11. A hydrostatically releasable coupling assembly as defined in claim 9 wherein one of said lashing plates includes spring means for applying tension between said lashing plates such that when said plunger assembly is moved to said release position, said latching means is moved from said engaged position to said disengaged position and said lashing plates are separated.

12. A hydrostatically releasable coupling assembly as defined in claim 9 and including means for moving said plunger assembly from said locking position to said release position in response to a predetermined hydrostatic pressure.

13. A hydrostatically releasable coupling assembly as defined in claim 9 wherein said plastic collar is substantially cylindrical.

14. A hydrostatically releasable coupling assembly as defined in claim 9 wherein said metal portion is a metal disc on said plunger body.

15. A hydrostatically releasable coupling assembly as defined in claim 9 wherein said plastic collar is formed of one of an acetal homopolymer and a thermoplastic polyester.

16. A hydrostatically releasable coupling assembly as defined in claim 9 wherein said plunger body and said metal portion are formed of stainless steel.

* * * * *